United States Patent [19]

Okuda

[11] Patent Number: 4,894,893

[45] Date of Patent: Jan. 23, 1990

[54] PNEUMATIC REED DRAWING-IN APPARATUS

[75] Inventor: Tetsuo Okuda, Hashima, Japan

[73] Assignee: C K D Kabushiki Kaisha, Komaki, Japan

[21] Appl. No.: 197,031

[22] Filed: May 20, 1988

[30] Foreign Application Priority Data

Jun. 11, 1987 [JP] Japan ..... 62-90179[U]
Oct. 9, 1987 [JP] Japan ..... 62-154948[U]

[51] Int. Cl.[4] ..... D03J 1/14
[52] U.S. Cl. ..... 28/204; 28/202
[58] Field of Search ..... 28/202, 203, 204

[56] References Cited

FOREIGN PATENT DOCUMENTS 57-23020 5/1982 Japan .
60-224841 11/1985 Japan ..... 28/204

*Primary Examiner*—Werner H. Schroeder
*Assistant Examiner*—Jodi Tokar
*Attorney, Agent, or Firm*—Emmanuel J. Lobato; Robert E. Burns

[57] ABSTRACT

Here is disclosed an apparatus for successive drawing-in of warp through repsective reed blade gaps of a reed in the automatic loom, comprising a nozzle disposed above the reed which is movable transversely of the reed blades and extended from an upper portion to a bottom side thereof by a warp end feeding slit having its upper opening serving as a warp end inlet, its lower opening serving as a warp end outlet and its front opening narrower than the interior of the warp feeding slit itself; and the nozzle is further provided therein with an air injection port adapted to inject a stream of pressurized air downwardly into the warp end feeding slit substantially in the form of a parallel-flow and thereby to produce an air stream flowing from the warp end inlet towards the warp end outlet under an ejector effect.

4 Claims, 9 Drawing Sheets

PNEUMATIC REED DRAWING-IN APPARATUS

BACKGROUND OF THE INVENTION

1. Field of the Invention

The present invention relates to an apparatus for drawing-in warp through a reed blade gap, as preparatory process for weaving or netting operations in an automatic loom, and particularly to such apparatus adapted to be pneumatically operated.

2. Description of the Prior Art

The pneumatic reed drawing-in apparatus is well-known from the disclosure of the Japanese Patent Publication No. 57-23020, in which the pressurized air injection nozzle is opposed to the reed blade gap so that, after the stream of said pressurized air flowing through the nozzle functions to suck the warp end from the rear end of the nozzle into the latter and then to blow it out from the front end of said nozzle, the door provided laterally of the nozzle is opened so as to let the intermediate portion of a warp end escape to the exterior. However, such apparatus of known prior art has encountered various problems. Specifically, in view of the requirement that a nozzle door must be opened to provide the way of escape for the intermediate portion of a warp end, there must be provided a device for opening and shutting of said nozzle door, which leads not only to complexity of the structure but also to limitation of the work efficiency because of the time taken for opening and shutting of the nozzle door. Additionally, if a warp end can not be smoothly curved when the warp end is laterally sucked, there occurs sometimes a situation such that the warp end is held in a bowed condition across the nozzle inlet and can not be sucked into the nozzle, since the nozzle door remains closed during warp feeding. To avoid such situation, the warp end must be manually inserted into the nozzle inlet necessarily with a substantial lowering of the work efficiency.

SUMMARY OF THE INVENTION

An essential object of the present invention is to provide an improved pneumatic reed drawing-in apparatus allowing the warp end to be smoothly drawn-in through the reed blade gap without provision of any door means in a way of escape for an intermediate portion of the warp end.

In view of this object, the present invention broadly resides in a pneumatic reed drawing-in apparatus including a nozzle provided in its front side with a warp end feeding slit vertically but partially extending therethrough, said slit having an upper opening as a warp end inlet, a lower opening as a warp end outlet and a front opening as a way of escape for an intermediate portion of the warp end narrower than the interior of the slit, and further provided therein with an air injection port formed, through which a stream of pressurized air flows downwardly into the warp end feeding slit substantially as a parallel-flow and then, under an ejector effect, flows from the warp end inlet towards the warp end outlet, wherein such nozzle is movable above a reed transversely of reed blades. The feature that the pressurized air supplied from the air injection port into the warp end feeding slit flows therethrough practically as the parallel-flow and the front opening of the slit serving as the way of escape for the intermediate portion of the warp end is narrower than the interior of said slit conventiently results in the air stream flowing through the warp end feeding slit from the warp end inlet towards the warp end outlet forms a substantially straight parallel-flow and, therefore, an amount of air stream flowing out through the way of escape for the intermediate portion of the warp end is very small. With a consequence, the warp end fed towards the warp end outlet is blown out through the warp end outlet without escaping through the way of escape for the intermediate portion of the warp end, then reliably drawn-in through the reed blade gap and thereafter the intermediate portion of the warp end escapes through the way of escape for this portion of the warp end. Thus, an operation of the reed drawing-in is completed. The feature that there is provided no door means in the way of escape for the intermediate portion of the warp end advantageously simplifies the structure and shortens the cycle time, improving the work efficiency. Furthermore, even when the specific type of warp end which can not be easily curved is laterally sucked, the warp end is reliably sucked into the warp end feeding slit, while the intermediate portion of the warp end is brought into the way of escape for this portion of the warp end, and blown out through the warp end outlet into the reed blade gap. In this manner, the operation of reed drawing-in is reliably and effectively achieved.

BRIEF DESCRIPTION OF THE DRAWINGS

FIGS. 5 and 6 show a second embodiment of the present invention, in which FIG. 5 is a side sectional view and FIG. 6 is a plan view of an ejector guide used in this embodiment; and FIGS. 7 through 10 show a third embodiment of the present invention, in which FIG. 7 is a side sectional view, FIG. 8 is a plan view showing this embodiment with a nozzle being removed for clarity, FIG. 9 is an enlarged sectional view taken along a line C—C in FIG. 7, and FIG. 10 is a sectional view showing a variant of a shield employed in this embodiment.

DESCRIPTION OF PREFERRED EMBODIMENTS

Several embodiments of the present invention will be described in reference with the accompanying drawings.

Figure 1:
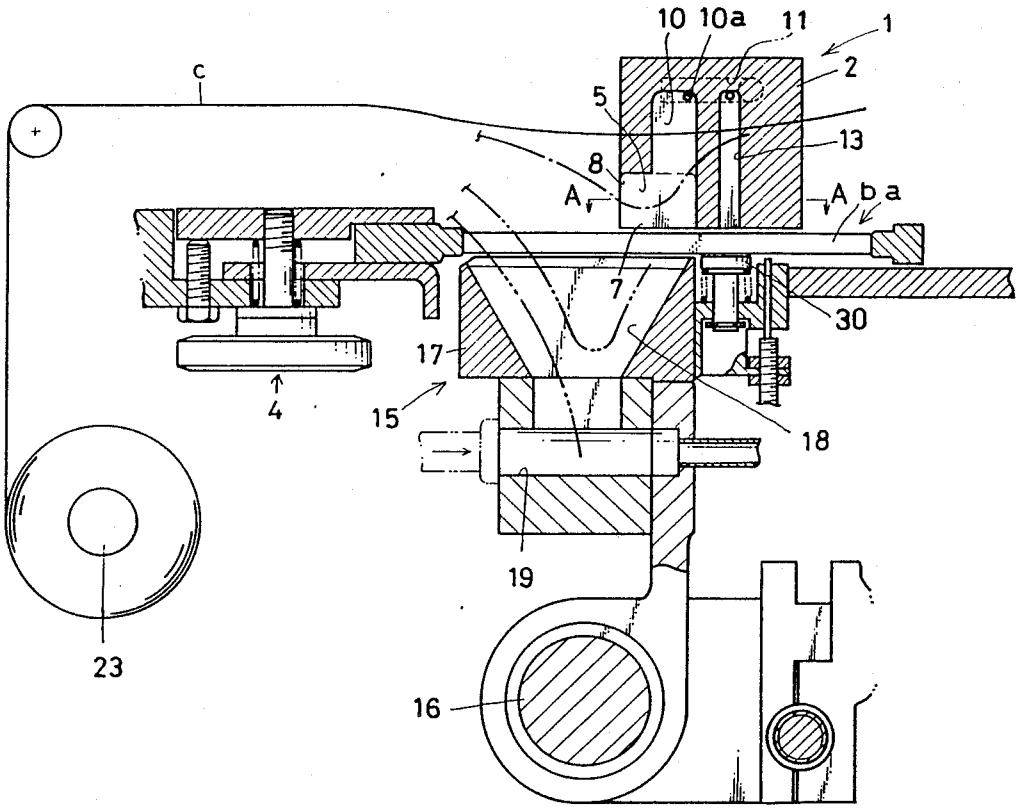
FIG. 1 is a side sectional view showing a first embodiment of the present invention.
Figure 2:
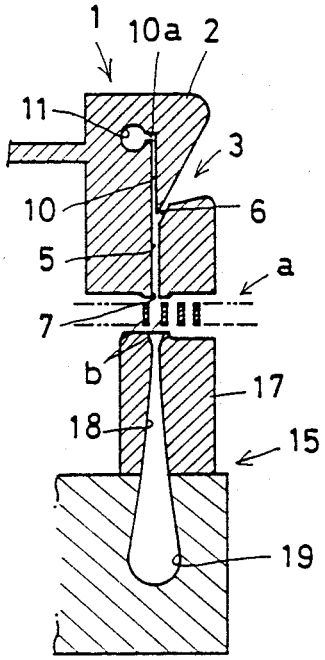
FIG. 2 is a front sectional view showing a part of this embodiment.
Figure 3:
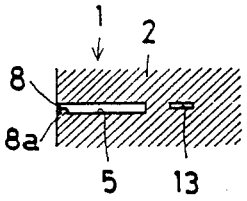
FIG. 3 is a sectional view taken along a line A—A in FIG. 1.
Figure 4:
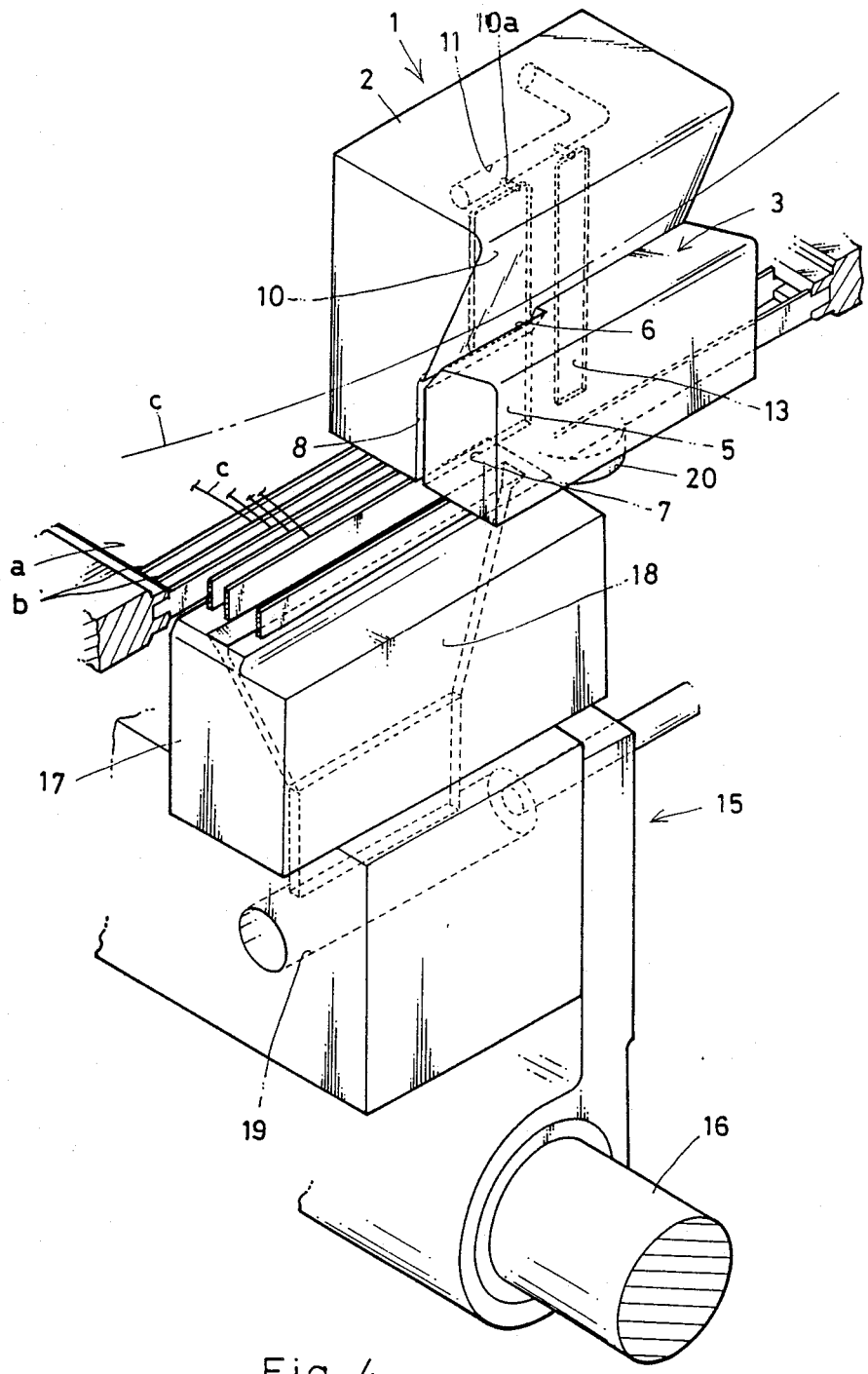
FIG. 4 is a perspective view showing this this embodiment.

In a first embodiment of the invention shown by FIGS. 1 through 4, a nozzle 1 adapted for pneumatically drawing-in an end of warp c through a gap defined between each pair of adjacent blades b of a reed a is movable above the reed a horizontally mounted on a mount 4 transversely of the reed blades b at regular pitches corresponding to the respective reed blade gaps. As seen in FIG. 2, this nozzle 1 comprises a block-like nozzle body 2 having an upper portion of its one side slantwise inwardly cut away to form a warp end introducing guide 3. The nozzle body 2 is provided in its front side with a narrow warp end feeding slit 5 vertically extending from a bottom of said warp end introducing guide 3 down to a lower side of the nozzle body 2. The warp end feeding slit 5 is formed in the nozzle body 2 with a predetermined depth as measured from said front side and includes its upper end opening in said warp end introducing guide 3 serving as a warp end inlet 6, its lower opening serving as a warp end outlet 7 and its front opening serving as a way of escape 8 for the intermediate portion of warp c, said way of escape 8 being reduced in its width relative to the interior of the warp end feeding slit 5 by provision of a ridge 8*a* along one side wall of this front opening, as seen in FIG. 3. Referring to FIG. 1, immediately above the warp end feeding slit 5, there is formed also in the nozzle body 2 a narrow injection port 10 extending from a position inwardly retracted with respect to the front opening of said warp end feeding slit 5 to the bottom of the latter, in fluid communication with the upper end of said warp end feeding slit 5. This injection port 10 communicates through a communication port 10*a* formed in the upper end of said injection port at the bottom thereof with an air supplying port 11 formed in the nozzle body 2. Behind the warp end feeding slit 5, there is provided also in the nozzle body 2 an auxiliary injection port 13 having a width substantially corresponding to each reed blade gap and in fluid communication with said air supplying port 11 to inject an air stream into the associated gap of the reed blades b and thereby to widen this gap.

Under the reed a, there is provided a warp suction device 15 movable along a guide bar 16 in unison with said nozzle 1 to suck the end of warp c towards the lower side of the reed a. This warp end suction device 15 comprises a main body 17 provided in its top side along a front half area of the reed a with a suction port 18 in alignment with each gap of the reed blades b. The suction port 18 is tapered in longitudinal direction thereof towards its lower end at which the suction port 18 communicates with an air passage 19 so that a stream of pressurized air may be supplied through this air passage 19 to establish a negative pressure within the suction port 18. Additionally, a shield 30 is mounted on the main body 17 of the warp end suction device 15 to block the lower side of the reed blade gap at a position just below the auxiliary injection port 13 of said nozzle 1.

The present embodiment functions as follows:

With the warp end outlet 7 and the auxiliary injection port 13 of the nozzle 1 as well as the suction port 18 of the warp end suction device 15 being aligned with the associated gap defined between a pair of adjacent reed blades b, when the air supplying port 11 of the nozzle 1 is supplied with pressurized air, the stream of this pressurized air is injected from the communication port 10*a* opening at the top end of the injection port 10 into the latter substantially in the form of a straight flow of air so as to establish a downwardly directed parallel-flow of pressurized air predominantly along the bottom of the warp end feeding slit 5. Thus, the air stream flows as a practically straight laminar flow under an ejector effect from the warp end inlet 6 towards the warp end outlet 7 and simultaneously an air stream injected from the auxiliary injection port 13 into the associated gap between a pair of adjacent reed blades b impinges upon the shield 30 so as to widen said reed blade gap. At the same time, the air passage 19 of the warp suction device 15 may be supplied with pressurized air to establish a negative pressure within the suction port 18. At this time point, the delivery end of warp c stored around a reel 23 is manually held and pulled so far until said delivery end of warp c is pulled beyond the nozzle 1 and approaches is the warp end inlet 6 of the warp end feeding slit 5 through the warp end introducing guide 3. The delivery end of warp c is sucked thereby into the warp end feeding slit 5 with the intermediate portion of warp c being brought into the way of escape 8, as indicated by a single dotted chain line in FIG. 1, since the air stream flowing through said warp end feeding slit 5 from the warp end inlet towards the warp end outlet 7 flows, as previously mentioned, practically as the straight parallel-flow predominantly along the bottom of the warp end feeding slit 5 and the amount of air stream flowing out through the way of escape 8 opening in the front side of the nozzle body 2 is extremely small. The warp end is then blown out from the warp end outlet 7 into the associated reed blade gap and simultaneously sucked into the suction port 18 of the warp end suction device 15 under the effect of the negative pressure established within said suction port 18. In this manner, the delivery end is drawn-in through the associated reed blade gap while the intermediate portion of warp c is let escape out from the way of escape 8 and thereby said warp c is brought to the front side of said gap.

With the present embodiment, as has been described above, the substantially parallel air stream flows through warp feeding slit 5 predominantly along the bottom thereof and the way of escape 8 is narrower than the interior of said warp end feeding slit 5. Such feature allows the delivery end of warp c to be blown out from the warp end outlet 7 without a possibility of escaping through the way of escape 8 for the intermediate portion of warp c in spite of the fact there is provided in the way of escape 8 no door means. Even with a specific type of warp c which can not be smoothly curved, the intermediate portion of warp c is brought into the way of escape 8, then the delivery end is sucked along the bottom of the warp end feeding slit 5 and blown out from the warp end outlet 7. So there is no possibility, as sometimes encountered by the apparatus of prior art including the nozzle door, that the delivery end of warp c is held in a bowed condition between the upper edge of said door means and the upper edge of the warp end inlet and thereby prevented from being smoothly sucked into the warp end feeding slit.

In the present embodiment, furthermore, there is provided under the reed a the warp end suction device 15 to suck the delivery end of warp c. This feature assures the reliable drawing-in of warp c and makes it possible to bring the end of warp c to one side of each reed blade gap.

Figure 5:
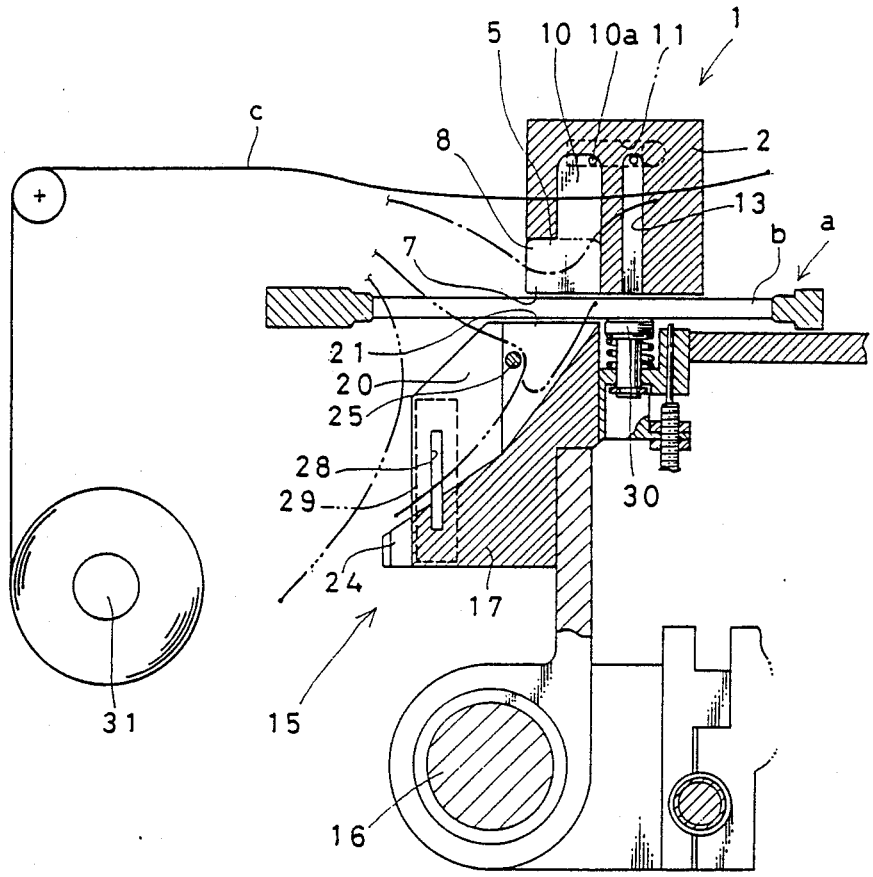
Figure 6:
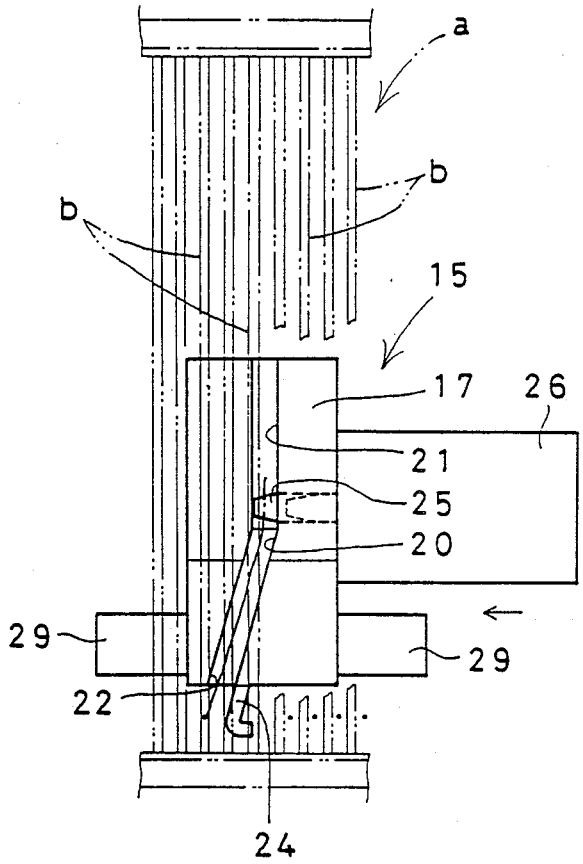
Figure 7:
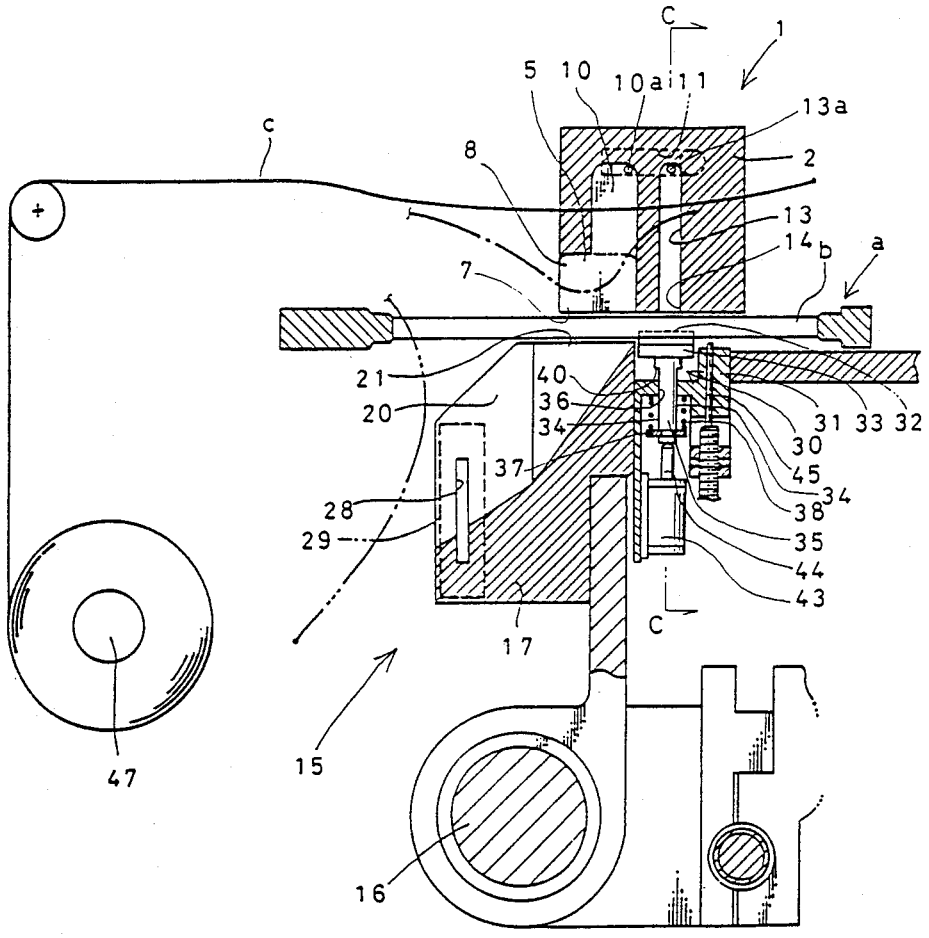
Figure 8:
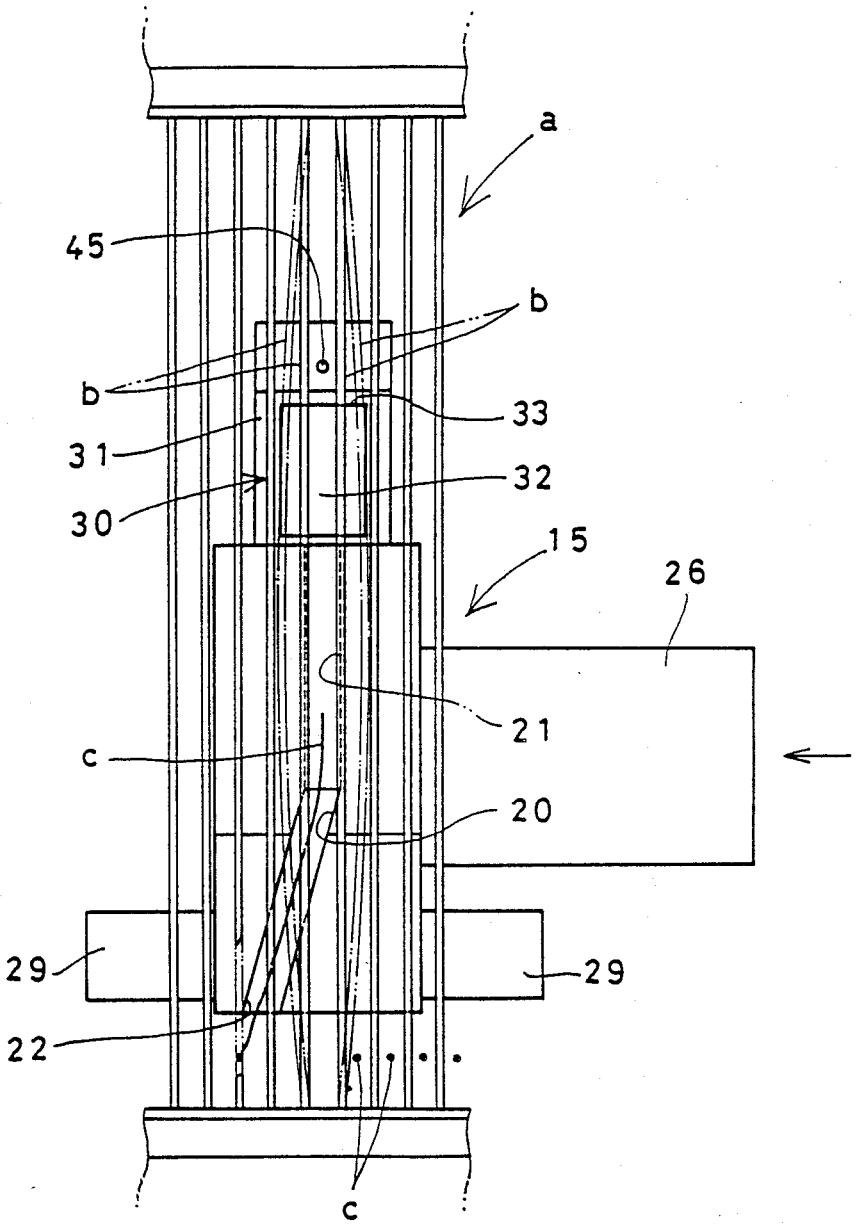
Figure 9:
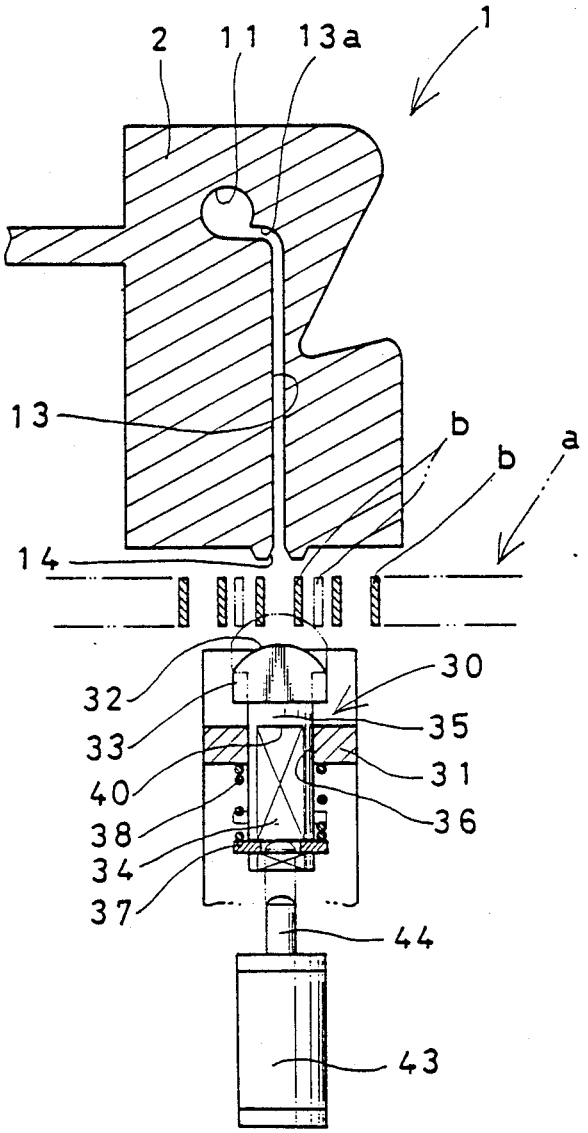

Now, a second embodiment of the present invention will be described in reference with FIGS. 5 and 6. It should be noted here that the nozzle 1 of the present embodiment is similar in its construction and operation to that in the previously described first embodiment and, therefore, the same parts are designated with the same reference numerals without any repeated explanation thereof.

Under the reed a, there is provided an ejector guide 15 movably along the guide bar 16 in unison with said nozzle 1 to guide the end of warp c already drawn-in through the associated reed blade gap towards the front side of this gap. The main body 17 of this ejector guide 15 is formed therein with a narrow guide slit 20 opening continuously along the top and front sides of said main body 17. As seen in FIG. 6, the front end of this main body 17 extends at an angle to a plane of the reed blades b. The upper opening of said guide slit 20 defines a warp end inlet 21 corresponding to the warp end outlet 7 of the nozzle 1 while the front opening of said guide slit 20 defines in front of said warp end inlet 21 with respect to the movement of the ejector guide 15 a warp end outlet 22, at the lower end of which there is provided a separator plate 24. The separator plate 24 projects forward from the rear edge of the warp end outlet 22 with respect to the movement of the ejector guide 15 and has its front end bent like a hook directed rearward also with respect to the movement of the ejector guide 15.

The guide slit 20 carries on its upper portion transversely thereof a catching pin 25 horizontally extending from one side wall and normally held against the opposite side wall of the guide slit 20. The catching pin 25 is adapted to be retracted into said one side wall by a drive force of a solenoid 26 provided on a side of the guide body 17. Adjacent the warp end outlet 22, a pair of slot-like windows 28, 28 extending through the respective side walls of the guide slit 20 and respectively opening in the respective outer side surfaces of the guide body 17. In operative association with these slot-like windows 28, 28, there is provided on opposite outer sides of the guide body 17 sensor means 29 utilizing infrared ray or the like adapted to detect when warp c is present between said pair of slot-like windows 28, 28.

The present embodiment of the aforementioned construction functions as follows:

After the nozzle 1 has been moved together with the ejector guide 15 to align the warp end outlet 7, the auxiliary injection port 13 and the inlet 21 with the associated gap of the reed blades b, the air supplying port 11 of the nozzle 1 is supplied with pressurized air so that the air stream directed from the warp end inlet 6 towards the warp end outlet 7 of the nozzle 1 passes through the gap of the reed blades b and flows through the inlet 21 of the ejector guide 15 into the guide slit 20 and then flows out through the outlet 22. In such a situation, the delivery end of warp c stored around the reel 31 disposed in front of the nozzle 1 is manually held and pulled by a length of warp c enough to extend to a position behind the nozzle 1 and said delivery end is brought close to the warp end inlet 6 through the warp end introducing guide 3. The delivery end of warp c is sucked into the slit 5 and blown out from the warp end outlet 7. Then, the delivery end of warp c passes through the reed blade gap while the intermediate portion of warp c escapes through the way of escape 8. Thereafter, the delivery end of warp c is guided through the inlet 21 of the ejector guide 15 into the guide slit 20 and caught by the catching pin 25. In this manner, even when the delivery end has been self-entangled, the air stream flowing through the guide slit 20 will disentangle the delivery end which is, in turn, blown thereby towards the outlet 22. When the delivery end passes between the slot-like windows 28, 28, the sensor means 29 detects this and outputs a detection signal indicating that the delivery end of warp c has passed through the reed blade gap. Upon receiving this detection signal, the solenoid 26 is activated to drive the catching pin 25 to be retracted and the current line of warp c which has passed through the reed blade gap is blown out through the outlet 22 forward with respect to the ejector guide 15 at an angle with the imaginary vertical line passing the reed blade gap. The outlet 22 is located at a distance from the preceding line of warp c which has previously been drawn-in through the reed blade gap and vertically suspended and the air stream flowing out through the outlet 22 is oriented so as to go away from said preceding line of warp c which has previously been drawn-in. This arrangement is effective to prevent said preceding line of warp c which has previously been drawn-in through the reed blade gap from being entangled with the current line of warp c blown out through the outlet 22 under the effect of the air stream. Furthermore, the separator plate 24 of this embodiment projecting forward from the opening edge of the outlet 22 assures that any possible self-entaglement of warp c is avoided due to the effect of the air stream even when the preceding line of warp c which has previously been drawn-in is sucked by the air stream towards the outlet 22. After the current line of warp c has been blown out from the ejector guide 15, further supply of pressurized air is stopped and thereupon the current line of warp c is vertically suspended by gravity just below the front end of the reed blade gap through which the current line of warp c has been drawn-in. The operation as mentioned above may be repeated for successive drawing-in of warp c through the respective reed blade gaps.

Now a third embodiment of the present invention will be described in reference with FIGS. 7 through 10. It should be understood that the nozzle 1 of the present embodiment is similar in its construction and operation to that in the previously described first embodiment while the ejector guide 15 of this embodiment is similar in its construction and operation to that in the previously described second embodiment and, therefore, the same parts are designated by the same reference numerals without any repeated explanation thereof. Immediately below the outlet 14 of the auxiliary injection port 13, the ejector guide 15 includes the shield 30 fixedly mounted by a bracket 31 on the rear side of the main body 17 in order to block the air stream injected from said outlet 14 at the lower side of the reed blades b, b and thereby to increase a pressure within the gap between these reed blades b, b so that this gap may be widened.

This shield 30 comprises a main body 33 having a circular cross-sectioned thrust surface 32 on its top and a leg 35 extending downwardly from its bottom. Said leg 35 includes opposite flat portions 34, 34 formed by cutting the round periphery of this leg 35. The leg 35 is inserted into a through-hole 36 of the bracket 31 which is matched in its shape to the cross-section of the leg 35 so that said leg 35 may be supported vertically slidably but unrotatably around its vertical axis. The thrust surface 32 is opposed to the outlet 14 of the auxiliary injection port 13 with the crest thereof extending in parallel to the reed blades b. Between a spring bearing ring 37 secured around the lower end of the leg 35 and the bottom surface of the bracket 31 there is provided a compression coil spring 38 adapted to normally hold a stepped portion 40 formed in the upper end of the leg 35 in engagement with the edge of said through-hole 36 of the bracket 31 and thereby to keep the thrust surface 32 of the shield 30 being spaced downwardly from the associated reed blades b, b, as indicated by a solid line in FIG. 9. Below the shield 30, the bracket 31 is provided on its lower portion with drive means 43 utilizing air cylinder or solenoid. The drive means 43 includes a rod 44 upwardly projecting therefrom which is normally retracted so as to be spaced downwardly from the leg 35. When the drive means 43 is activated by supplying the air cylinder with pressurized air or by exciting of the solenoid, the rod 44 is driven upwardly until the upper end thereof strikes the bottom surface of the leg 35 and thereby urges the shield 30 upwardly. Behind the shield 30, the bracket 31 is provided with a detector 45 electrically connected to a control unit (not shown) in order to detect relative positions of the nozzle 1 and the ejector guide 15 to the reed blades b.

The present embodiment of the aforementioned construction functions as follows:

After the nozzle 1 has been moved together with the ejector guide 15 to align the warp end outlet 7, the outlet 14 of the auxiliary injection port 13 and the inlet 21 with the adjacent gap of the reed blades b, b, the detector 45 outputs a detection signal with which the control unit is activated to stop further movement of the nozzle 1 and the ejector guide 15 and at the same time the drive means 43 is also activated to extend the rod 44 which has been maintained retracted so as to urge the shield 30 upwardly against the elasticity of the compression coil spring 38 until the circular cross-sectioned thrust surface 32 of said shield 30 comes in contact with the lower edges of the adjacent reed blades b, b and thereby blocks the lower plane of the gap defined between these reed blades. Simultaneously, the air supplying port 11 of the nozzle 1 is supplied with pressurized air. The air stream having spouted out from the warp end outlet 7 of the nozzle 1 passes through the gap between the reed blades b, b, then flows through the inlet 21 of the ejector guide 15 into the guide slit 20 and then flows out from the ejector guide 15 through the outlet 22 thereof while the air stream spouts from the auxiliary injection port 13 through the outlet 14 thereof against the thrust surface 32 of the shield 30 so as to increase a pressure within the gap between the reed blades b, b now blocked by said thrust surface 32 along the bottom plane of said gap. Additionally, the thrust surface 32 tapered in the vertical direction is driven to thrust into the gap of the reed blades b, b so that these two reed blades b, b are subjected to an elastic deformation as indicated by two-dotted chain lines in FIG. 8, as the shield 30 is driven upwardly, and, in consequence, spaced more and more from each other at a longitudinally middle area. Certainly there occurs von Kármán's votex street because these reed blades b, b are placed in the air stream. However, these reed blades b, b are free from any inconvenient vibration, since the reed blades b, b are intensely urged against the thrust surface 32 under the effect of their restoring elasticity once said thrust surface 32 has thrusted into the gap between these reed blades b, b.

In such a situation, the delivery end of warp c stored around the reel 47 disposed in front of the nozzle 1 is manually held and pulled by a length of warp c enough to extend to a position behind the nozzle 1 and said delivery end of warp c is brought close to the warp inlet 6 through the warp introducing guide 3. The delivery end of warp c is sucked into the slit 5 and blown out from the warp end outlet 7. Then, the delivery end of warp c passes through the gap of the adjacent reed blades b, b held sufficiently spaced from each other without any contact with these reed blades b, b while the intermediate portion of warp c escapes through the way of warp escape 8. The current of warp c which has passed through the reed blade gap is guided through the inlet 21 of the ejector guide 15 into the guide slit 20 and then blown towards the outlet 22, passing between the slot-like windows 28, 28. The current line of warp c is then blown out through the outlet 22, forward with respect to the ejector guide 15, at an angle with the imaginary vertical line passing the reed blade gap through which this line of warp c has just passed. In other words, the current line of warp c is blown away from the preceding line of warp c which has previously been drawn-in through the associated reed blade gap and vertically suspended without any possibility that the preceding line of warp c previously drawn-in through the reed blade gap associated with this particular line of warp c might be entangled with the current line of warp c blown out through the outlet 22 under the effect of the air stream. When the current line of warp c passes between the slot-like windows 28, 28 as said portion of warp c is blown out from the ejector guide 15, the sensor means 29 detects and outputs a detection signal which causes the control unit to output a control signal with which further supply of the pressurized air is stopped. As a result, the current line of warp c is vertically suspended by gravity just below the front end of the reed blade gap through which this line of warp c has been drawn-in. Simultaneously the drive means 43 is activated to retract the rod 44 thereof so that the shield 30 is lowered together with the thrust surface 32 thereof under the elasticity of the compression coil spring 38. Thereupon, the adjacent reed blades b, b restore the initial spacing and the thrust surface 32 is spaced downwardly from said reed blades b, b again. The operation as mentioned above may be repeated for successive drawing-in of warp c through the respective reed blade gaps.

Although the thrust surface 32 in this embodiment has been illustrated and described as having the circular cross-section, the thrust surface is not intended to be limited to such specific configuration and may have various angular cross-sections such as a triangular cross-section.

Figure 10:
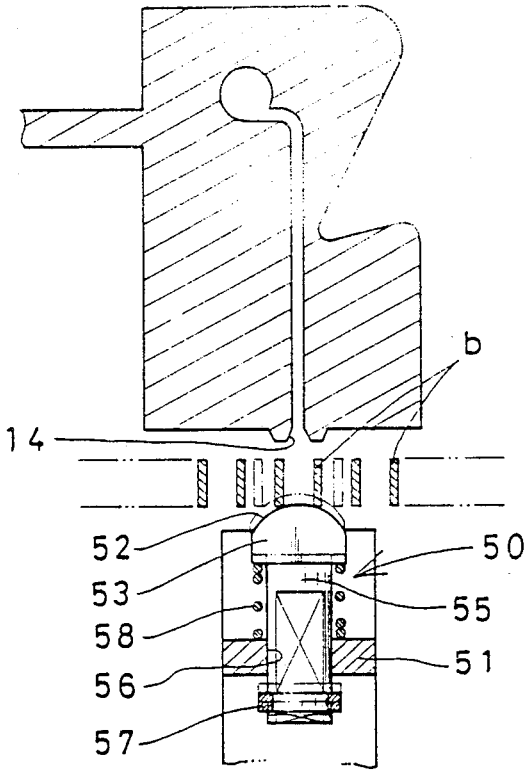

FIG. 10 depicts a variant of the shield 30 which is generally designated by reference numeral 50. The shield 50 according to this variation comprises a main body 53 defining on its top a thrust surface 52 having a circular cross-section, a leg 55 extending downwardly from the bottom of said main body 53, a bracket 51 formed with a through-hole 56 through which said leg 55 slidably but unrotatably extends, a retaining ring 57 carried on the lower end of the leg 55, and a compression coil spring 58 disposed between the bottom surface of the main body 53 and the top surface of the bracket 51. Under the elasticity of this compression coil spring 58, the thrust surface 52 is normally urged against the lower edges of the adjacent reed blades b, b so that the shield 50 widens the spacing of these reed blades b, b as said shield 50 moves upwards. During movement of the nozzle 1 together with the ejector guide 15, the leg 55 is retractable under action of suitable pulling means (not shown). During drawing-in of warp c, the air stream injected through the outlet 14 of the auxiliary injection port 13 increases a pressure within the gap between these adjacent reed blades b, b and this increased pressure cooperates with said elasticity of the compression coil spring 58 to widen the spacing betwen said reed blades b, b.

I claim:

1. A pneumatic reed drawing-in apparatus comprising, a nozzle, a reed having reed blades, said nozzle being movable above said reed transversely of the reed blades thereof, said nozzle having a warp end feeding slit opening in a front side of said nozzle and partially extending through said nozzle from an upper portion down to a lower side thereof adjacent said reed blades, said warp end feeding slit having its upper opening as a warp end inlet, its lower opening as a warp end outlet and its front opening narrower than the interior of said warp end feeding slit itself as a way of warp escape, an air injection port formed in said nozzle to inject a stream of pressurized air downwardly into said warp end feeding slit substantially in the form of a parallel-flow so that an ejector effect of said stream of pressurized air develops a stream of air flowing through said warp end feeding slit from said warp end inlet towards said warp end outlet, wherein, after said warp end outlet has been aligned with a gap defined between each pair of adjacent ones of said reed blades, an end of warp guided into said warp end feeding slit is blown out with said air stream through said warp end outlet and drawn-in through said gap of the adjacent reed blades while an intermediate portion of warp is let escape through said way of warp escape, a warp end suction device having a narrow suction port alignable with said gap defined between the adjacent reed blades and to suck said warp end under effect of a negative pressure and wherein said warp end suction device is movable in unison with said nozzle, and said nozzle being provided adjacent said warp end outlet with an auxiliary air injection port and wherein said nozzle carries, below said reed, a support movable integrally with said nozzle, said support carrying a shield to block said gap of said adjacent reed blades associated with said auxiliary air injection port so that a stream of pressurized air injected from said auxiliary air injection port impinges on said shield to curve said adjacent reed blades to effectively widen said gap.

2. A pneumatic reed drawing-in apparatus as recited in claim 1, further including an ejector guide below said reed having a guide slit extending therethrough from an inlet opening in the upper side to an outlet opening in the front side of said ejector guide so that said end of warp having passed through said gap is guided with said air stream through said guide slit from said inlet to said outlet; wherein said outlet is formed so as to be located in front of said inlet with respect to the movement of said nozzle; and wherein the ejector guide is movable in unison with said nozzle.

3. A pneumatic reed drawing-in apparatus as recited in claim 2, wherein there is provided a separator plate projecting from an edge of said outlet formed in the front side of said ejector guide that is rearward with respect to the movement of said ejector guide in order to separate the current line of warp from the preceding line of warp that has previously been drawn-in.

4. A pneumatic reed drawing-in apparatus as recited in claim 2 or 3, wherein there is provided within said guide slit of said ejector guide a retractable catching pin laterally projecting and being adapted to catch said intermediate portion of warp.

* * * * *